United States Patent [19]

Thornhill

[11] 4,091,718

[45] May 30, 1978

[54] METHOD AND APPARATUS FOR FORMING COMPOSITE CONTAINER INCLUDING A TAB-CUT LABEL LAYER

[75] Inventor: Dewey B. Thornhill, St. Charles, Mo.

[73] Assignee: Boise Cascade Corporation, Boise, Id.

[21] Appl. No.: 759,336

[22] Filed: Jan. 18, 1977

[51] Int. Cl.[2] ..... B31C 1/06

[52] U.S. Cl. ..... 93/39.1 R; 93/55.1 M

[58] Field of Search ..... 93/39.1 R, 55.1 R, 55.1 M, 93/80, 94 R, 94 M, 77 CL, 39 C; 113/120 Q, 120 XY; 229/51 BP

[56] References Cited

U.S. PATENT DOCUMENTS

| | | | |
|---|---|---|---|
| 2,901,162 | 8/1959 | Vallas | 229/51 BP |
| 3,087,393 | 4/1963 | Pottle | 93/80 X |
| 3,241,739 | 3/1966 | Ahlemeyer | 229/51 BP |
| 3,506,183 | 4/1970 | Turpin et al. | 229/51 BP |
| 3,981,433 | 9/1976 | Thornhill et al. | 229/51 BP |

*Primary Examiner*—James F. Coan

*Attorney, Agent, or Firm*—Lawrence E. Laubscher

[57] ABSTRACT

A one-step easy-open composite container for dough products and the like, together with a method and apparatus for forming the same, are disclosed, which composite container includes a fibrous body wall layer having an unbonded helical butt joint, an impervious inner liner layer that is folded to define an expansible folded portion that extends helically the length of the container opposite the helical butt joint, an outer label layer wound helically in adhesively-bonded relation upon the body wall across the butt joint, and at least one end closure member closing one end of the body wall-label laminate, characterized in that the overlapping edge of the outer label layer is precut—prior to winding on the body wall layer—by a tab cut which is arranged at an acute angle relative to the separation line of end cut in laterally spaced relation to the helical butt joint. Consequently, when the pull tab portion defined by the tab cut is pulled to partially tear the label from the container, the body wall butt joint is exposed and is automatically expanded by the product packaged in the container to open the inner liner layer folded portion along the butt joint.

14 Claims, 10 Drawing Figures

METHOD AND APPARATUS FOR FORMING COMPOSITE CONTAINER INCLUDING A TAB-CUT LABEL LAYER

BRIEF DESCRIPTION OF THE PRIOR ART

The use of composite containers for packaging products such as biscuit dough and the like are well known in the patented prior art, as evidenced, for example, by the U.S. Pat. Nos. to Fienup et al 2,793,126 and Geist et al 2,793,127 and 3,144,193. As shown in the Geist et al U.S. Pat. No. 3,144,193, it is conventional in the art to provide in the outer surface of the tubular composite body wall adjacent one metal end closure member a continuous circumferential "collar" cut that extends completely through the label layer to define at one edge portion thereof a triangular-shaped pull tab portion. By means of this pull tab portion, the outer label layer may be removed from the container, whereupon the container is struck laterally against a sharp edge surface (of a kitchen counter or table, for example) to effect bursting of the body wall along the helical butt joint contained therein.

It is also known in the art, as evidenced, for example, by the Vallas U.S. Pat. Nos. 2,891,714 and 2,901,162, to provide a slit or cut in the edge portion of a label layer to define a pull tab portion for removing the label layer from the container, which slit extends parallel with the plane of the metal end closure member. Following removal of the label layer, printed instructions on the body wall become visible for instructing the user how to strike the container against a sharp edge to open the same along a perforated line of weakness.

Finally, in the recently issued Thornhill et al U.S. Pat. No. 3,981,433, a one-step easy-open container for refrigerated dough products and the like is disclosed, in which the container automatically opens (owing to the pressure of the dough product packaged therein) when the label layer is partially removed from the container by pulling on a tab portion defined in the label layer by a circumferential collar cut provided in the outer surface of the container. To this end, the unbounded helical butt joint of the body wall layer is straddled on its inner surface by a helically extending expansible fold portion of the impervious liner layer.

These known composite containers possess certain inherent structural and/or functional drawbacks. In the case of composite containers of the collar cut type, the circumferential cut extends completely around the container, thereby intersecting the abutted edges of the helical seam of the fibrous body wall layer to produce a critically weak area adjacent the point of intersection. Thus, the inner liner layer is the only material holding the pressurized product in at that point. Furthermore, when the collar cut is formed in the composite container wall, generally the collar cutting means extends not only through the label layer, but also partially into the fibrous body wall layer (up to a depth of 0.010 inches or more) thereby weakening the body wall of the container circumferentially. Furthermore, in a collar cut container, the moisture formed by condensation on the outer surface of the container penetrates the collar cut and into the fibrous body wall layer, thereby weakening the container strength and, in some cases, causing the container to burst open at the helical seam. Moreover, the cutting of a circumferential collar cut on a container, or a partial collar cut (as shown by the aforementioned Vallas patents) on a completed container, requires additional handling and supporting of the container during manufacture, thereby increasing tooling costs and unit manufacturing time.

The present invention was developed to avoid the above and other drawbacks of the known composite containers.

SUMMARY OF THE INVENTION

Accordingly, a primary object of the present invention is to provide an improved one-step easy-open composite container for dough products and the like in which the label layer is provided—prior to the winding thereof onto the body wall layer—with a plurality of longitudinally spaced tab cuts that are each arranged at an acute angle relative to the line of end cut of the label layer, whereby the corresponding angle between the tab cut and the overlapping edge of the label layer defines a pull tab portion for initiating tearing the label layer from the container. More particularly, after the label layer containing the tear cuts is wound upon the tubular body wall layer, the tear cut extends generally in the direction of the metal end, thereby all but eliminating the area of the body wall layer that may be exposed to moisture. In addition, the label tear cut on the bias completely seals off the critical point of the helical but joint in the body wall from any direct moisture penetration, thereby reducing market potential failure. Furthermore, the label tear cut on the bias completely eliminates cutting into the fibrous body wall layer, thereby eliminating the weakening of the body wall of the container circumferentially. In accordance with an important advantage of the invention, by eliminating these critically weak areas, the manufacturer can use lighter materials without sacrificing container strength or market integrity. Consequently, material cost savings to the manufacturer has the advantage of eliminating the scoring knives at the tube cutting station and related tooling and maintenance of this tooling. Overall, tooling cost, spoilage and maintenance downtime are greatly reduced.

In accordance with a more specific object of the invention, the novel label containing the bias cut tab portion is used in connection with a fibrous body wall layer having an unbonded helical butt joint across which is mounted an impervious inner liner layer which is folded to define an expansible portion that extends helically of the container opposite the body wall butt joint. When the pull tab is pulled to partially tear the label layer from the container circumferentially adjacent the metal end, it will tear for a distance sufficient to expose the butt joint which expands (owing to the pressurized dough product) to separate the edges thereof and, consequently, to expand the folded inner liner portion to automatically open the same, thereby to permit removal of the packaged dough product from the container.

In accordance with a further object of the invention, in one embodiment, the circumferential end cut is slightly spaced from the tab cut, and in another embodiment, the cuts are contiguous. In order to assist in the tearing away of the label from the body wall along a circumferential tear line adjacent the metal end closure member a layer of conventional adhesive-resistant material (such as lecithin [a soybean-type produce with fatty acid base], silicone or microcystalline wax) or a conventional release adhesive (such as polyvinyl alcohol and polyvinyl acetate formulation using clay and water, or various groups of hot melts) may be provided on those portions of the surface of one of the body wall and label layers facing the other of these layers which contain the circumferential cuts, the remaining portions of the surface being coated with a conventional liquid adhesive (such as a polyvinyl alcohol adhesive) for bonding the label layer to the body wall layer. To further assist in the tearing of the label layer from the body wall layer, the surface portion of the body wall layer may consist of reprocessed news lining, the remaining portion of the body wall layer consisting of reprocessed kraft stock. The impervious liner layer normally comprises a metal foil (such as aluminum foil) faced with kraft paper, and the label layer may similarly be formed of a metal foil faced with kraft paper, the paper layers of these laminates facing the fibrous body wall layer.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
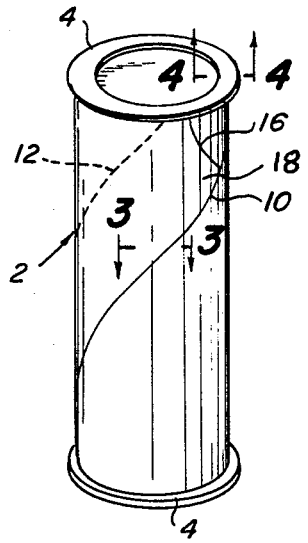
FIG. 1 is a perspective view of the composite container of the present invention.

The composite container of the present invention includes a tubular composite body wall 2 the upper and lower ends of which are closed by conventional metal end closure members 4. The composite body wall layer includes an impervious inner layer 6, a fibrous body wall layer 8, and an outer label layer 10, which layers are helically wound in the same sense upon a mandrel and are adhesively bonded together by a conventional liquid adhesive (for example, a polyvinyl alcohol adhesive). More particularly, the impervious inner layer 6 is formed from a metal foil-kraft paper laminate, the paper layer of which is bonded to the fibrous body layer 8. Similarly, the outer label layer 10 may comprise a metal foil-kraft paper laminate, the paper layer 10*a* of which is bonded to the fibrous body wall layer 8, and the metal foil layer 10b of which is exposed and carries the printed advertising indicia. In order to assist tearing of the label layer from the fibrous body wall layer, the fibrous body wall layer 8 may include a surface portion 8*a* that is formed from reprocessed newspaper stock, the remaining portion 8*b* of the fibrous body wall layer 8 being formed of reprocessed kraft paper.

As in the invention disclosed in the aforementioned Thornhill et al U.S. Pat. No. 3,981,433, the adjacent edges of the helical butt joint 12 contained in the fibrous body wall layer 8 are unbonded, one edge portion 6a of the inner liner layer 6 terminating short of the butt joint. The other longitudinal edge portion of 6*b* of the inner liner layer 6 extends in straddling relationship across the butt joint and above the first edge portion 6*a*, said second edge portion being reversely folded back upon itself to define a third inner liner portion 6*c* that extends between the first and second liner portions 6*a* and 6*b*. The third liner portion 6*c* terminates short of the butt joint 12 and at least the free extremity thereof is bonded to the adjacent edge of the first edge portion 6*a*. Thus, the inner liner portion 6*a*, 6*b* and 6*c* define an expansible folded seam that straddles the unbonded butt joint 12 and isolates the same from the moisture of a product, such as leavened dough 14 in the form of biscuits.

Figure 2:
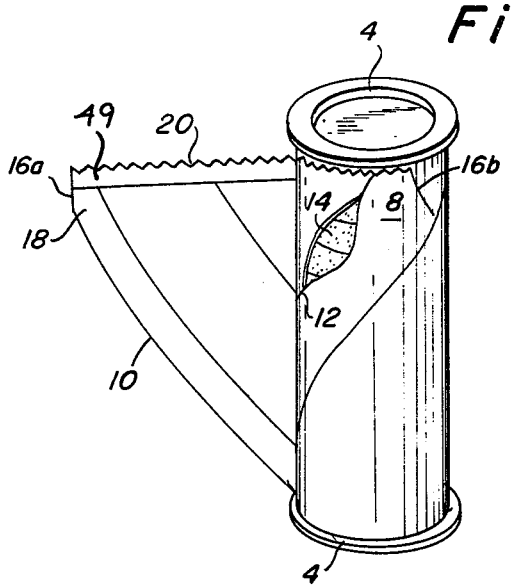
FIG. 2 is a perspective view of the container of FIG. 1 with the label layer partially torn away to permit automatic bursting of the inner liner layer along the helical body wall butt joint.
Figure 3:
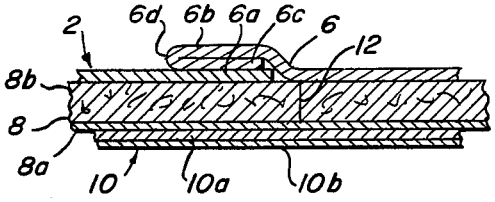
FIGS. 3 and 4 are sectional views taken along lines 3—3 and 4—4, respectively, of FIG. 1.
Figure 5:
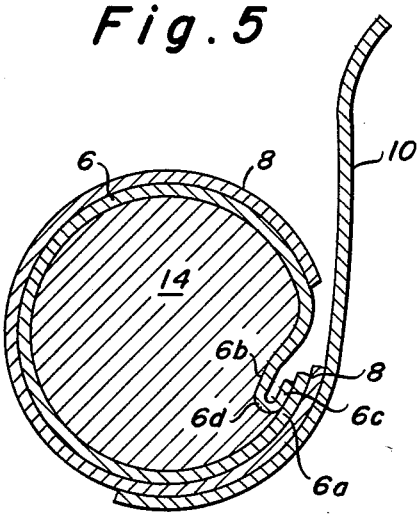
FIGS. 5 and 6 are transverse sectional views of the container illustrating the one-step opening operation of the container.
Figure 6:
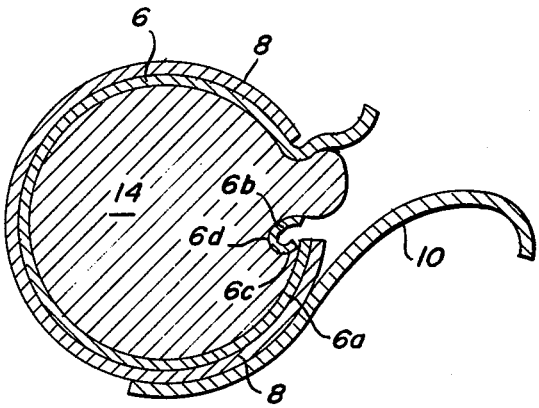

In accordance with the present invention, overlapping edge of the label layer 10 is provided with a tab cut 16 which extends generally toward the adjacent upper metal end portion 4, thereby defining a pull tab portion 18 on the label layer. As shown in FIGS. 2, 5, and 6, when the user pulls on the pull tab portion 18, the label layer 10 is progressively torn from the body layer 8 to expose the unbonded butt joint, one edge 16*a* of the tab cut being carried by the pull tab portion 18 and the other edge 16*b* being spaced from the butt joint 12, whereupon the pressure of the packaged dough product causes the mating edges of the butt joint to separate to permit progressive expansion of the inner layer 6. As shown in FIGS. 5 and 6, the inner liner 6 is caused to rupture either at a line of weakness defined by a creased fold line 6*d*, or by pulling the reversely folded third portion 6*c* progressively away from the inner liner first edge portion 6*a*. During this partial removal of the outer label layer 10, it is torn at its upper end along a circumferential tear line 20 adjacent the upper metal end closure member 4 as shown in FIG. 2. The label layer 10 is progressively removed until a sufficient portion of the butt joint 12 is exposed to permit the expansion thereof by twisting the metal end members 4 in opposite directions to further open the butt joint to permit the removal of the packaged products from the container.

Figures 7, 8:
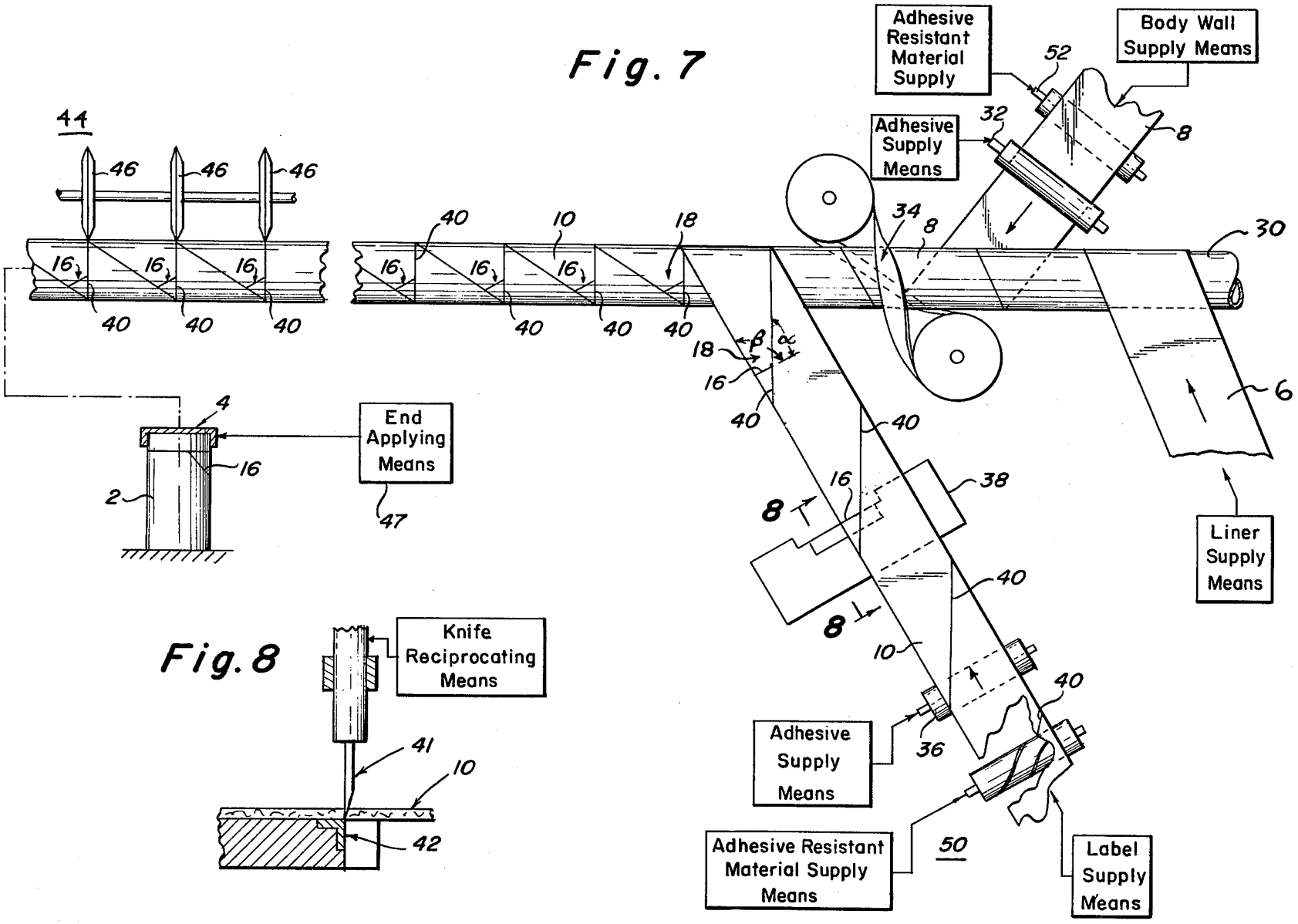
FIG. 7 is a somewhat diagrammatic top view of a first method and apparatus for producing the composite container of FIG. 1.
FIG. 8 is a detailed view taken along line 8—8 of FIG. 7.

Referring now to FIG. 7, it will be seen that the inner liner layer 6 is initially helically wound upon a stationary mandrel 30, and the fibrous body wall layer 8 has a layer of liquid adhesive applied to the upper surface thereof by an adhesive-applying roller 32 prior to the helical winding thereof upon the outer surface of the liner layer 6. The body wall-inner liner layer laminate is longitudinally displaced to the left on the mandrel 30 by means of conventional belt conveying means 34.

Figure 4:
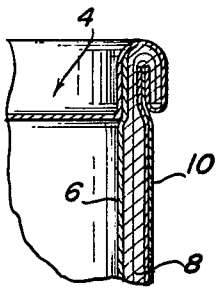

The outer label layer 10 is fed longitudinally in edge-overlapping relation to the mandrel 30 and is coated on its lower surface with a layer of liquid adhesive by the adhesive supply means 36. In accordance with the present invention, the label layer 10 passes through a cutting station 38 which includes vertically arranged reciprocatory knife means 41 (FIG. 8) that reciprocate vertically relative to a stationary shear member 42, thereby to form in the label layer 10 a plurality of successive parallel longitudinally-spaced tab cuts 16. Each of the tab cuts 16 is arranged at an acute angle ($\alpha$) relative to the associate line of end cut 40 (which will be discussed below), said tab cut being angularly arranged to the label edge to define the tab portion 18. The length of each tab cut 16 is about three-fourth of an inch, said tab cut terminating either immediately adjacent or slightly spaced from the end cut severing lines 40 (which may or may not be printed on the label layer). The pre-tab cut label layer 10 is then wound helically in edge-overlapping adhesively bonded relation upon the outer surface of the body wall layer 8, whereupon the resulting laminate is conveyed by the belt conveyor means 34 toward a cutting station 44 including a rotatably mounted knife 46 that circumferentially cuts the tubular laminate into cylindrical sections along circumferential cuts defined by the dividing lines 40. Alternatively, the laminate could be severed in desired longer lengths (for example, an eight can length), and be removed from the mandrel 30 for severing into sections at another cutting station, as desired. In any event, the severed sections are transported to an end applying station 47 at which a metal end 4 is connected with the composite tubular body wall 2 in any conventional manner (for example, by the rolled seam illustrated in FIG. 4). In accordance with the specific feature of the invention, it may be desirable to apply to the mating surfaces of either of the body layer 8 or the label layer 10 opposite the line of circumferential end cut 40 a layer 49 (FIG. 2) of either an adhesive resistant material (such as lecithin, silicone, or a microcrystalline wax) or a release adhesive (such as polyvinylchloride and polyvinylacetate formulation using clay and water, or various hot melts) whereby the label layer may be torn more readily from the fibrous body wall layer. Thus, prior to passage of the label layer 10 to the adhesive supply means 36, the label layer passes through a preliminary station 50 at which an adhesive resistant material or a release adhesive is coated on the under surface of the label layer opposite the line of circumferential cut 40. Alternatively, the adhesive resistant material or the release adhesive could be applied to the under surface of the body wall layer strip 8 by similar rotary applicator means 52 having a helical rib of suitable configuration.

Figure 9:
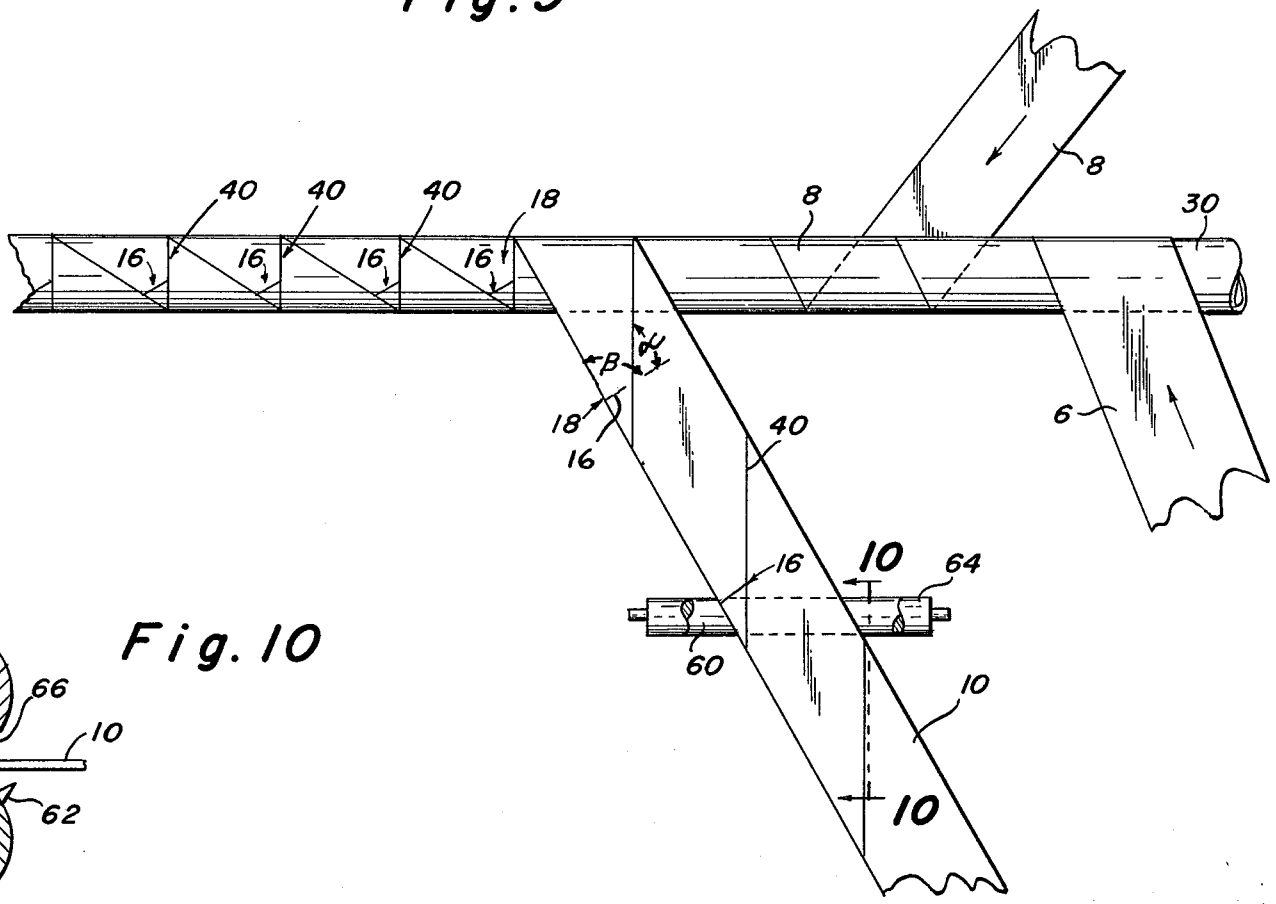
FIG. 9 is a diagrammatic illustration (with certain parts removed) of a modification of the apparatus of FIG. 7.
Figure 10:
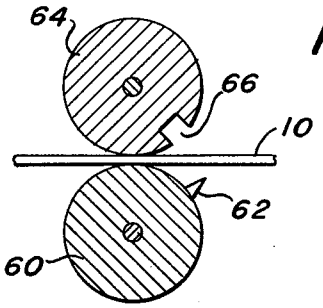
FIG. 10 is a detailed sectional view taken along line 10—10 of FIG. 9.

Referring now to the modification of FIG. 9, the reciprocatory cutter means of the embodiment of FIG. 7 are replaced with rotary cutter means 60 having a relatively short helical blade 62 for forming the tab cuts 16 in the edge portion of the label layer 10. In this embodiment, a backup roll 64 containing a slot 66 for receiving the knife blade 62 is arranged opposite the rotary cutting drum 60. As in the embodiment of FIG. 7, the tab cut 16 is arranged at an acute angle ($\alpha$) relative to the end dividing circumferential line of cut 40, whereby the angle ($\beta$) that is contained between the tab cut and the label layer edge defines the pull tab portion 18 on the label layer 10. Thus, in both embodiments of the invention, the tab cuts 16 are formed in the label layer prior to the winding thereof on the mandrel upon the outer surface of the fibrous body wall layer 8.

EXAMPLES

In the can manufacturing process, a spirally wound tube is formed by laminating a layer of paper board (97# basis weight) in combination with an aluminum foil inner liner around a stationary cylindrical mandrel. The inner liner (0.00035 inch aluminum and 30# basis kraft paper) is simultaneously heat sealed in a continuous spiral bond which provides the internal integrity of the final can, preventing or at least arresting the entrance/exit of moisture through this barrier. The last layer is generally a preprinted label (0.0003 inch aluminum foil and 40# basis kraft paper) which becomes the final outer wrap of the can. In the prior "collar cut" containers, this outer wrap is circumferentially cut with the cut extending not only through the label but also partially cutting into the fibrous body wall layer up to a depth of 0.010 inches or more. According to the present invention, by precutting the label layer with the tab cuts, the use of collar cutting means is eliminated. In any event 55 or 60# 2CR metal ends are attached to the can body. Within this construction, the internal contents of a leavened dough is contained as long as the dough remains chemically stable and there is no degradation in the structure of the can itself.

This multiple layered can makes it possible to use extremely thin, high cost materials only where they are strategically required in the construction, thereby allowing the paperboard to be sandwiched in between these materials to build strength and rigidity into the can body wall. Reiterating, a composite can of this construction is designed to withstand market conditions in relation to the chemical limitations of the internal dough product it must contain and the market environment in the retail dairy case.

The common term "shelf life" as it refers to the product is the time in which the dough product must be used before it chemically deteriorates. The can is so designed that it will last longer than the shelf-life of its contents. Thus, it is around a prescribed set of conditions that any changes or alterations are made in the can construction since preservation of the product is of prime consideration. Since changes in materials and technology are always present and under consideration, a planned design to examine can integrity was established over the years and is accepted as an industry standard and referred to as a Condition III High Humidity test. The Condition III procedure outlined as follows is the path which most closely associates itself to an accelerated internal and external aging test of manageable proportions that may be considered representative of the market environment before usage:

(a) cans are packed with leavened dough to greater than normal manufacturing dough weights, designed to deliberately stress the can materials from the inside;

(b) the packed cans are then submitted to a (1) hour proofing period at 90° F to activate the leavening agent in the dough; and (c) the packed cans are then subjected to an abusive exterior environment of high humidity in temperature cycling as defined—4 hours at 40° F, 2 hours at 40°–60° F, 4 hours at 60° f, 2 hours at 60°–40° F, etc.

Under the high humidity conditions, the dew point is passed from 60°–40° F thus causing condensation to form around and on the exterior of the can. This condition will cause premature failure of weaker can constructions and in those cans with critical defects.

Thus, a specific test may be conducted to purposefully measure a particular manufacturing alteration; as in this case, the opening characteristics of cans with various label cuts and basis weight body stock papers. As always these "experimental cans" with the particular design or material change are tested under these conditions and compared simultaneously to the conventional collar-cut cans, known as "controls".

To illustrate the cost savings potential of the tab cut label over the conventional collar-cut label, label tests were conducted under the procedure previously described.

Table I is specific as to the actual material construction of each of the experimental and control cans.

TABLE I

| | EXPERIMENTAL #1 TAB-CUT LABEL | EXPERIMENTAL #2 CONTROLLED DEPTH CUT | CONTROL CONVENTIONAL CUT |
|---|---|---|---|
| Label | Foil to kraft .0003/40# | Foil to kraft .0003/40# | Foil to kraft .0003/40# |
| Liner | Foil to kraft .00035/30# | Foil to kraft .0003/40# | Foil to kraft .00035/30# |
| Board | .021" 80 lb. basis wt. | .021" 80 lb. basis wt. | .026" 97 lb. basis wt. |
| Adhesive | PVA | PVA | PVA |

Table II illustrates the design and test results used for comparison to gain factual data on (a) reduced basis weight paper board with the new tab-cut label (b) reduced basis weight paper with a controlled conventional label cut depth (c) the conventional label cut using 97 lb. basis weight paper.

TABLE II

| Dough | EXPERIMENTAL #1 TAB-CUT LABEL 80# BASIS WT. | | EXPERIMENTAL #2 CONTROLLED DEPTH CUT 80# BASIS WT. | | CONTROL CANS CONVENTIONAL COLLAR-CUT 97# BASIS WT. | |
|---|---|---|---|---|---|---|
| Batch | R1 | R2 | R1 | R2 | R1 | R2 |
| A | 28.00 days | 28.00 days | 25.30 days | 25.85 days | 28.00 days | 28.00 days |
| B | 27.70 | 27.45 | 24.55 | 28.00 | 28.00 | 26.05 |
| C | 27.80 | 27.55 | 26.75 | 25.90 | 28.00 | 28.00 |

Explanation:
R1 and R2 indicate replicate sample groups. n - 20 per replicate.

| Table Summary: | EXPERIMENTAL #1 | EXPERIMENTAL #2 | CONTROL |
|---|---|---|---|
| Average Deviation $\bar{x}$ | 27.75 days | 26.06 days | 27.68 days |
| Standard Deviation s | ±0.23 days | ±1.20 days | ±0.80 days |
| n - 20 per replicate | 6 sample groups | 6 sample grps. | 6 sample groups |

From the above test we can draw the following statistically based conclusion to determine the average can life. This is done on a computer evaluation using the null and alternate hypothesis along with standard "T" tests. All were observed at the 97.5% confidence level for the can treatments as set up in this experimental design.

In summary, the cans in experimental #1 (tab-cut label/80# basis wt. paper) are equal to or better than cans in experimental #2 (controlled label cut depth/80# basis wt. paper) and the control cans (conventional collar-cut/97# basis wt. paper). These results indicate a manufacturing cost savings can be achieved by using the tab-cut label/80# basis wt. paper can construction over the conventional collar-cut label using 97# basis wt. paper without reducing can integrity. At today's paper market pricing the savings could be between 15 and 20%.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. The method of manufacturing a composite container for dough products and the like, comprising the steps of (a) helically winding on a mandrel an impervious inner liner layer strip (6);

(b) helically winding a fibrous body wall layer strip (8) in the same sense as, and in adhesively bonded relation on the external surface of, said helically-wound inner liner layer, said body wall layer having a helical unbonded butt joint (12) the adjacent edges of which are contiguous, said liner layer including a helically extending folded expansible portion (6a, 6b) bonded to said body wall layer on both sides of, and extending solely in straddling relation across the inner surface of, said body wall helical butt joint;

(c) cutting in one longitudial edge of a label layer strip 10) a plurality of longitudinally-spaced parallel tab cuts (16) angularly arranged relative to the longitudinal axis of said label layer strip;

(d) helically winding the label layer strip in adhesively-bonded relation on the external surface of, in the same winding sense as, and in straddling relation across the butt joint of, said body wall layer, thereby to form a tubular laminate, said label layer being wound in edge-overlapping relation with said one edge portion being exposed and laterally offset from said butt joint;

(e) transversely cutting the tubular laminate along longitudinally spaced lines of circumferential end cuts contained in planes normal to the longitudinal axis of the tubular laminate, thereby to define a plurality of cylindrical laminate sections, said label layer strip being wound with each of said tab cuts arranged in laterally spaced relation relative to the associated butt joint and extending toward said end cut at an acute angle ($\alpha$) relative to said end cut, whereby a pull tab portion (18) is defined in said label layer between the tab cut and the label layer edge; and (f) securing to the end of the laminate section adjacent the tab cut a metal end closure member, whereby upon pulling of the tab portion of the label defined by the tab cut, the label is torn from the container assembly along a circumferential tear line adjacent the metal end closure member.

2. The method as defined in claim 1, wherein each circumferential cut in the laminate is contiguous with one end of the corresponding label layer tab cut.

3. The method as defined in claim 1, wherein each circumferential cut in the laminate is adjacent but slightly spaced from the end of the label layer tab cut.

4. The method as defined in claim 1, wherein one edge portion (6*a*) of said liner layer terminates adjacent a first side of said body wall helical butt joint, the other edge portion of said liner layer having a first portion (6*b*) which extends from the other side of said butt joint across and beyond said butt joint, and a reversely folded second portion (6*c*) which extends between said one edge portion and said first portion back toward said butt joint, the length of said second portion extending substantially the length of said first portion and terminating adjacent the edge of said one edge portion, the fold line (6*d*) between said first and second liner portions extending helically the length of the laminate section, the outer surface of said reversely folded second liner portion (6*c*) being secured to the inner surface of said liner layer one edge portion to permit relative expansion of said first and second liner portions.

5. The method as defined in claim 1, and further including the steps, prior to the label layer strip winding step, of (g) applying upon the surface of one of said body wall and label layers facing the other of said layers solely at transversely extending portions thereof containing the lines of circumferential cut a layer of adhesive-resistant material; and (h) applying a liquid adhesive to the remaining portions of said surface.

6. The method as defined in claim 1, and further including the steps, prior to the label layer strip winding step, of (g) applying upon the surface of one of said body wall and label layers facing the other of said layers solely at transversely extending portions thereof containing the lines of circumferential cut a layer of release adhesive; and (h) applying a liquid adhesive to the remaining portions of said surface.

7. Apparatus for manufacturing a composite container for dough products and the like, comprising the steps of (a) means for helically winding an impervious liner layer strip (6) upon a mandrel;

(b) means for helically winding in the same sense and with a helical butt joint (12) a body wall layer strip (8) in adhesively bonded relation on the outer surface of said liner layer, one edge portion (6*a*) of said liner layer terminating adjacent a first side of said body wall helical butt joint, the other edge portion of said liner layer having a first portion (6*b*) which extends from the other side of said butt joint across and beyond said butt joint, and a reversely folded second portion (6*c*) which extends between said one edge portion and said first portion back toward said butt joint, the length of said second portion extending substantially the length of said first portion and terminating adjacent the edge of said one edge portion, the fold line between said first and second liner portions extending helically the length of the butt joint, the outer surface of said reversely folded second liner portion being secured to the inner surface of said liner layer one edge portion to permit relative expansion of said first and second liner portions;

(c) means for cutting in one longitudinal edge of a label layer (10) a plurality of longitudinally-spaced parallel tab cuts (16) angularly arranged relative to the longitudinal axis of said label layer strip;

(d) means for helically winding said label layer strip in the same sense in edge-overlapping adhesively bonded relation on the external surface of said body wall layer in straddling relation across the helical butt joint contained therein;

(e) means for transversely cutting the tubular laminate along longitudinally spaced lines of circumferential end cuts contained in planes normal to the longitudinal axis of the tubular laminate, thereby to define a plurality of cylindrical laminate sections, each of said circumferential end cuts being laterally spaced from said butt joint adjacent one end of the associated tab cut; and (f) means operable for securing to at least that end of each laminate section adjacent the tab cut a metal end closure member, whereby upon pulling of the tab portion of the label defined by the tab cut, the label is torn from the container assembly along a circumferential tear line adjacent the metal end closure member.

8. The method of manufacturing a composite container for dough products and the like, comprising the steps of (a) helically winding on a mandrel an impervious inner liner layer strip (6);

(b) helically winding a fibrous body wall layer strip (8) in the same sense as, and in adhesively bonded relation on the external surface of, said helically-wound inner liner layer, said body wall layer containing helical unbonded butt joint (12), the outer surface of said body wall layer being lined with a layer of newsprint material, said liner layer including a helically extending folded expansible portion (6*a*, 6*b*) bonded to said body wall layer on both sides of, and extending in straddling relation across, said body wall helical butt joint;

(c) cutting in one longitudinal edge of a label layer strip (10) a plurality of longitudinally-spaced parallel tab cuts (16) angularly arranged relative to the longitudinal axis of said label layer strip;

(d) helically winding the label layer strip in adhesively-bonded relation on the external surface of said body wall layer, thereby to form a tubular laminate, said label layer being wound in edge-overlapping relation with said one edge portion exposed;

(e) transversely cutting the tubular laminate along longitudinally spaced lines of circumferential end cuts contained in planes normal to the longitudinal axis of the tubular laminate, thereby to define a plurality of cylindrical laminate sections, each of said tab cuts being arranged in laterally spaced relation to the associated butt joint at an acute angle relative to the associated end cut and terminating at one end adjacent thereto, whereby a pull tab portion (18) is defined in said label layer between the tab cut and the label layer edge; and (f) securing to the end of the laminate section adjacent the tab cut a metal end closure member, whereby upon pulling of the tab portion of the label defined by the tab cut, the label is torn from the container assembly along a circumferential tear line adjacent the metal end closure member.

9. The method of manufacturing a composite container for dough products and the like, comprising the steps of (a) helically winding an impervious liner layer strip (6) upon a mandrel;

(b) helically winding in the same sense and with a helical butt joint (12) a fibrous body wall layer strip (8) in adhesively bonded relation on the outer surface of said liner layer, one edge portion (6*a*) of said liner layer terminating adjacent a first side of said body wall helical butt joint, the other edge portion of said liner layer having a first portion (6*b*) which extends from the other side of said butt joint across and beyond said butt joint, and a reversely folded second portion (6c) which extends between said one edge portion and said first portion back toward said butt joint, the length of said second portion extending substantially the length of said first portion and terminating adjacent the edge of said one edge portion, the fold line between said first and second liner portions extending helically the length of said butt joint, the outer surface of said reversely folded second liner portion being secured to the inner surface of said liner layer one edge portion to permit relative expansion of said first and second liner portions;

(c) cutting in one longitudinal edge of a label layer (10) a plurality of longitudinally-spaced parallel tab cuts (16) angularly arranged relative to the longitudinal axis of said label layer strip;

(d) helically winding said label layer strip in the same sense in edge-overlapping adhesively bonded relation on the external surface of said body wall layer in straddling relation across the helical butt joint contained therein, said label layer strip being wound so that said tab cuts are laterally displaced from said butt joint;

(e) transversely cutting the tubular laminate along longitudinally spaced lines of circumferential end cuts contained in planes normal to the longitudinal axis of the tubular laminate, thereby to define a plurality of cylindrical laminate sections, said circumferential cuts being adjacent one end of said tab cuts, respectively, each of said tab cuts being formed in the exposed edge of said label layer and extending toward the associated end cut at an acute angle ($\alpha$) relative to said associated end cut, whereby the tab cut cooperates with the overlapping label layer edge to define a pull tab portion (18) in said label layer; and (f) securing to at least that end of each laminate section adjacent the tab cut a metal end closure member, whereby upon pulling of the tab portion of the label defined by the tab cut, the label may be torn from the container assembly along a circumferential tear line adjacent the metal end closure member.

10. Apparatus for manufacturing a composite container for dough products and the like, comprising (a) means for helically winding on a mandrel an impervious liner layer strip (6);

(b) means for helically winding in the same sense in bonded relation on said liner layer a fibrous body wall layer strip (8) to define a continuous helical unbonded butt joint (2), said liner layer strip containing an expansible folded portion which extends in straddling relation across, and helically the length of, said butt joint;

(c) means for cutting in one longitudinal edge of a label layer strip (10) a plurality of longitudinally-spaced parallel tab cuts (16) angularly arranged relative to the longitudinal axis of said label layer strip;

(d) helically winding in edge overlapping relation the label layer strip in the same sense and in adhesively bonded relation on the external surface of said body wall layer, said label layer extending in straddling relation across said body wall butt joint, thereby to form a tubular laminate;

(e) means for transversely cutting the tubular laminate along longitudinally spaced lines of circumferential cuts contained in planes normal to the longitudinal axis of the tubular laminate, thereby to define a plurality of cylindrical laminate sections, each of said tab cuts being arranged in the exposed edge of said label layer at an acute angle ($\alpha$) relative to the line of end cut in laterally spaced relation to the butt joint, whereby a pull tab portion (18) is defined between said tab cut and the adjacent label layer edge; and (f) means for securing to the end of the laminate section adjacent the tab cut a metal end closure member, whereby upon pulling of the label tab portion, the label is torn from the container assembly along a circumferential tear line adjacent the metal end closure member.

11. Apparatus as defined in claim 10, wherein said tab cut cutting means includes a reciprocatory cutting blade.

12. Apparatus as defined in claim 10, wherein said tab cut cutting means includes a helical cutting balde mounted on the periphery of a rotary drum.

13. Apparatus as defined in claim 10, and further including means for applying upon the surface of one of the body wall and label layers facing the other of said layers solely at transversely extending portions thereof containing the lines of circumferential cut a layer of adhesive-resistant material; and means for applying liquid adhesive to the remaining portions of said surface.

14. Apparatus as defined in claim 10, and further including means for applying upon the surface of one of said body wall and label layers facing the other of said layers solely at transversely extending portions thereof containing the lines of circumferential cut a layer of release adhesive; and means for applying a liquid adhesive to the remaining portions of said surace.

* * * * *